United States Patent [19]

Krehbiel

[11] Patent Number: 4,463,563

[45] Date of Patent: Aug. 7, 1984

[54] REPHASING CYLINDER CONSTRUCTION

[75] Inventor: Robert D. Krehbiel, Hutchinson, Kans.

[73] Assignee: The Cessna Aircraft Company, Wichita, Kans.

[21] Appl. No.: 917,035

[22] Filed: Jun. 19, 1978

[51] Int. Cl.[3] ..... F15B 15/18

[52] U.S. Cl. ..... 60/593; 60/546; 91/189 A; 91/402; 92/169

[58] Field of Search ..... 91/171, 189 R, 399, 91/402, 189 A; 60/546, 547 R, 560, 583, 593; 92/169

[56] References Cited

U.S. PATENT DOCUMENTS

| | | | |
|---|---|---|---|
| Re. 28,695 | 1/1976 | Freese | 60/546 |
| 2,221,813 | 11/1940 | Paulsen | 91/402 |
| 2,655,002 | 10/1953 | Terhune | 60/546 |
| 2,676,466 | 4/1954 | Klessig | 60/546 |
| 3,543,643 | 12/1970 | Southwell | 92/169 |
| 3,832,852 | 9/1974 | Schmucker | 60/546 |
| 4,009,641 | 3/1977 | Rohde | 92/169 |
| 4,140,044 | 2/1979 | Biller | 91/402 |
| 4,164,122 | 8/1979 | Ward | 60/547 R |

FOREIGN PATENT DOCUMENTS

| | | | |
|---|---|---|---|
| 494302 | 12/1975 | U.S.S.R. | 91/402 |

*Primary Examiner*—Abraham Hershkovitz
*Attorney, Agent, or Firm*—Edward L. Brown, Jr.

[57] ABSTRACT

An improved rephasing master cylinder in which the cylinder wall approximate the end of the cylinder has a longitudinal bleed passage in the cylinder wall at one end connected to a lateral passage opening into the forward cylinder chamber while the opposite end of the longitudinal passage connects with the rearward chamber of the cylinder when the cylinder piston is located therebetween. This longitudinal bleed passage permits the restricted flow past the master cylinder piston when the piston is nearing and at the end of its stroke, thereby causing both master and slave pistons to complete their respective strokes.

3 Claims, 3 Drawing Figures

REPHASING CYLINDER CONSTRUCTION

BACKGROUND OF THE INVENTION

1. Field of the Invention

This invention relates to a master fluid power cylinder capable of performing useful work while simultaneously controlling the coordinated operation of an associated slave cylinder which also performs useful work. In such a combination, it is often required that the pistons and the rods of the two cylinders start their movement at the same time, travel at substantially the same velocity, and reach the ends of their respective strokes at substantially the same time. This is necessary, for example, when two such cylinders are used to raise and lower opposite ends of the reel on a combine which harvests grain as it moves through the field.

Conventional master and slave cylinders can be so proportioned that they will have uniform movement. However, unequal wear of the working parts, particularly the fluid seals, causes the cylinders to get out of synchronization. They are said then to be out of phase and the operation of correcting this condition is sometimes called "rephasing".

2. Description of the Prior Art

The present state of the art on synchronizing master and slave cylinders by affording a restricted flow past the master cylinder piston at the end of the stroke is exemplified by U.S. Pat. No. RE. 28,695 issued to Evans Glenn Freese, and U.S. Pat. No. 3,832,852 issued to Loftin W. Schmucker, both of which belong to applicant's assignee.

The Freese Patent teaches a bleed orifice in the cylinder wall which passes completely through the cylinder wall into an exterior fitting or port, which is welded to the exterior of the cylinder wall. The present invention is limited to a cylinder configuration wherein the cylinder port is located in the bearing rather than welded to the cylinder wall.

The Patent to Schmucker teaches a bypass passage in the form of a groove on the inside surface of the cylinder wall extending longitudinally in the cylinder barrel. The main problem with the last mentioned longitudinal groove is that with the piston seal straddling the groove at the end of the stroke, the seal has a tendency to deform into the groove over a period of time, and when the piston is next moved, the deformed portion of the seal is sheared off.

SUMMARY OF THE INVENTION

This invention is more particularly concerned with an improvement on the design utilized in the aforementioned Schmucker Patent while affording restricted fluid communication between the rear and forward chambers of the master cylinder. In place of the groove in the cylinder wall, the present invention affords restricted communication between the forward and rearward chambers of the cylinder through a longitudinal passage in the cylinder wall which connects the bearing or head of the cylinder at one end, while at the opposite end, the longitudinal passage opens directly into the interior of the cylinder through a lateral passage. Once the cylinder piston has passed over the lateral passage, flow around the piston is thereby afforded through the longitudinal passage causing both pistons of the master and slave cylinders respectively to reach the ends of their stroke. The two cylinders are then synchronized for the next extension or retraction of the cylinders.

It is the principal object of this invention to simplify the manufacture, reduce the cost and outside dimensions of a master cylinder which synchronizes its stroke with a slave cylinder.

The further object of the present invention is to provide a rephasing cylinder with an improved seal life.

Another object of the present invention is to provide a double-acting working cylinder construction which provides relief against internal over-pressurization of the cylinder at both ends of the piston stroke in case the control valve directing pressure fluid to the cylinder is not closed just prior to or at approximately the instant the piston reaches the end of the stroke in either direction.

The invention will become more clearly understood when the following description is read in connection with the accompanying drawings in which.

DESCRIPTION OF THE PREFERRED EMBODIMENT

Figure 1:
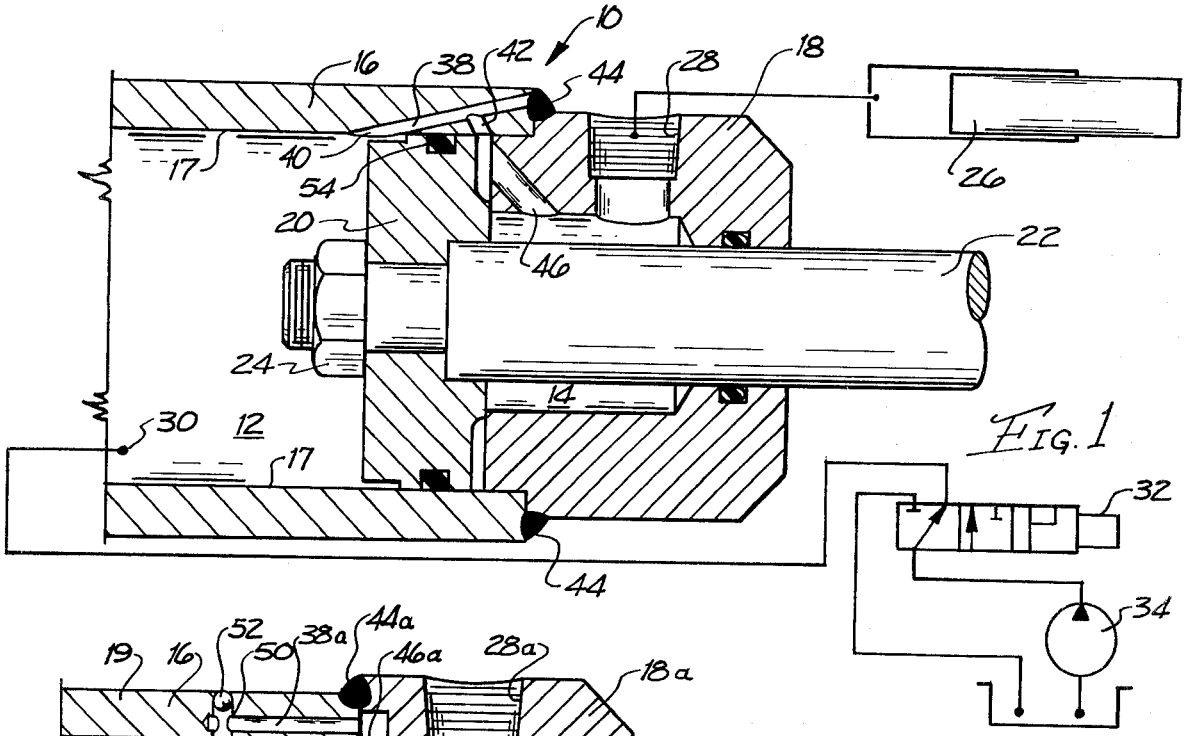
FIG. 1 is a partial longitudinal sectional view through a master cylinder embodying the present invention and schematically showing therewith the slave cylinder and the power system for operating the circuit.

A cylinder construction which embodies my invention is shown in FIG. 1 and is designated generally by reference numeral 10. Master cylinder 10 is a double acting cylinder including rearward and forward chambers 12 and 14 respectively. Cylinder 10 is made up of a cylinder wall 16 having an inside surface 17, closed at one end by a bearing or head 18 while the opposite end, not shown in the drawings, is of a similar configuration except for a closed end. Sliding within cylinder wall 16 is piston 20 attached to piston rod 22 by nut member 24. Cylinder 10 is connected in series to a single-acting slave cylinder 26 through port 28 in bearing 18. A cylinder port 30 is symbolically shown in the opposite end of the cylinder connecting to rearward chamber 12 with a three-way valve 32 which in turn supplies fluid pressure from pump 34.

Located within the interior of cylinder 16 is a longitudinal bleed passage 38 which is drilled from the open end of the cylinder barrel at a sufficient angle so that the passage intercepts the inside surface 17 of the cylinder wall through a lateral opening 40. Another lateral passage 42 is drilled from the open end of cylinder barrel 16 at an angle approximately normal to the axis of passage 38. Bearing 18 is attached to the cylinder wall 16 by a welded circumferential joint 44 which also closes the open end of bleed passage 38. Port 28 located in bearing 18 connects with the forward chamber 14 of the cylinder and the longitudinal bleed passage 38 via transfer passage 46.

Figure 2:
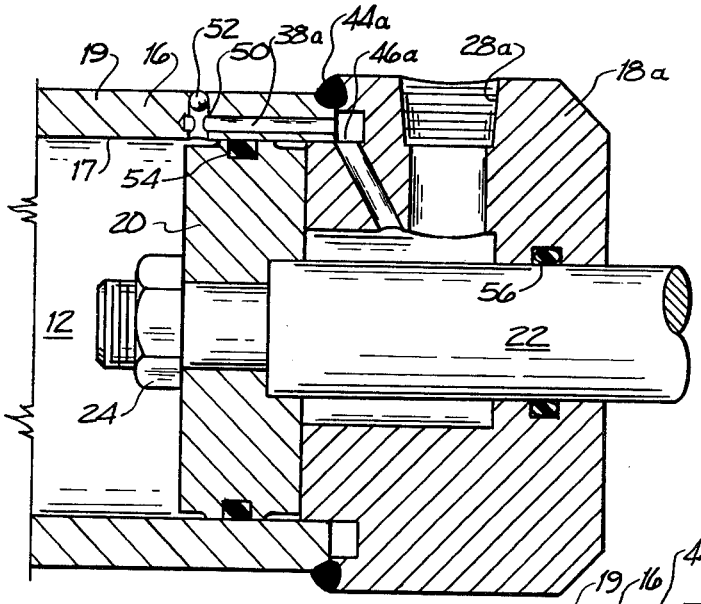
FIG. 2 is a partial longitudinal sectional view through a master cylinder showing a modified design.

FIG. 2 illustrates a modified form of the invention wherein the longitudinal bleed passage **38*a* is parallel with the axis of the cylinder between the inside and outside surfaces 17 and 19 of the cylinder wall. Drilled through the cylinder wall 16 is a lateral bleed passage 50 which first intersects longitudinal passage 38*a* and then opens into rearward cylinder chamber 12. The outer end of lateral passage 50 is closed by a press-fitted steel ball 52 or any other type of plug means available. Longitudinal passage 38***a* exits through the end of the cylinder wall 16 into a transfer passage 46*a* in the bearing 18*a* which in turn connects to port 28*a*. Bearing 18*a* is connected to the cylinder wall 16 by its circumference weld 44*a* which is located on the outside surface 19 of the wall so as not to obstruct longitudinal bleed passage 38*a*. Piston 20 and bearing 18*a* have conventional o-ring seals 54 and 56 for sealing flow between the two chambers of cylinder and flow between the bearing 18*a* and piston rod 22.

Figure 3:
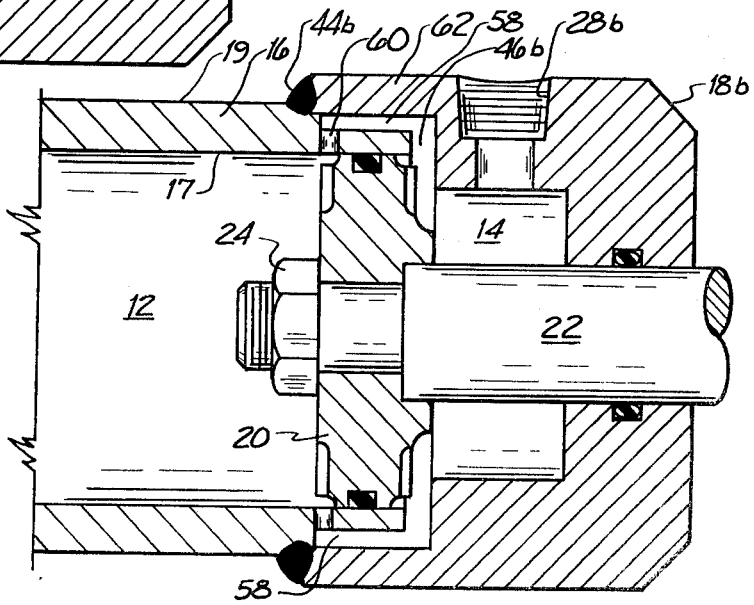
FIG. 3 is a partial longitudinal sectional view through a master cylinder showing a further modified design.

FIG. 3 illustrates a modified form of the present invention wherein the longitudinal bleed passage in the end of the cylinder wall 16 comprises a cutaway portion 58 which is formed by cutting away the outside surface 19 of the cylinder wall leaving the inside surface 17 unchanged. Located at the inner end of the cutaway portion 58 is a lateral passage 60 which intersects therewith to provide an opening into rearward cylinder chamber 12. Bearing 18*b* is shaped with an overlapping portion 62 which overlays the cutaway portion 58 and is welded to the outside surface of the cylinder wall by weld 44*b*. The cutaway portion 58 of the cylinder wall connects with port 28*b* through transfer passage 46*b*.

OPERATION

When both piston rods 22 and 26 are in the retracted position, the master and slave cylinders 10 and 26 respectively are positioned for cycling. Three-way control valve 32 is moved to its far left position, as seen in the drawing, which allows pressurized fluid from pump 34 to enter the head-end of master cylinder 10 through port 30. Pressurized fluid in rearward chamber 12 causes piston 20 to extend to the right, forcing the fluid in forward chamber 14 out port 28 into single-acting slave cylinder 26. The volumes of forward chamber 14 and cylinder 26 are matched so that an equal volume of fluid achieves an identical stroke for either cylinder. As piston 20 approaches the end of its stroke, o-ring seal 54 passes over opening 40, allowing pressure in rearward chamber 12 to flow across piston 20 into forward chamber 14 via longitudinal bleed passage 38 and lateral passage 42. This bypass flow flows into slave cylinder 26 causing it to extend to the limit of its stroke to make up for any possible leakage which might take place on either of the cylinder rods or across piston 20. In a condition where slave cylinder 26 reaches the end of its stroke before master cylinder piston 20 reaches the end of its stroke, the bypass flow is in the reverse direction from chamber 14 across bleed passage 38 into chamber 12 allowing piston 20 to continue to the end of its stroke.

While only one end of the master cylinder 10 is shown, the opposite end could also have a similar rephasing bypass passage 38 if rephasing is required at both ends. Some applications require rephasing at only one end while others require it at both ends of the master cylinder.

It will be understood from the above description that a number of master cylinders could be connected in series, and that the first master would extend and retract the pistons of all the cylinders in unison.

Having described the invention with sufficient clarity to enable those familiar with this art to construct and use it, I claim:

1. A fluid power cylinder utilized in a series circuit with a slave cylinder in a master-slave relationship, the power cylinder having a cylinder wall, forward and rearward heads welded to the ends of the cylinder wall, the rearward head having a port therein for exterior fluid communication with a valve which selectively: (a) provides communication with a pump supplying fluid pressure, (b) closes off communication with the power cylinder, or (c) provides communication with a drain; the forward head having a port therein, the slave cylinder having a single port therein for exterior fluid communication with the port in the forward head; a piston rod extending outwardly from the slave cylinder; a piston having a circumferential seal in sliding contact with the inside surface of the power cylinder wall, dividing the cylinder into forward and rearward chambers, a piston rod attached to the piston and extending outwardly through the forward head, wherein the improvement comprises:

a lateral passage in the power cylinder wall positioned approximate at least one end of the cylinder and located so that the piston seal passes over the lateral passage near that end of the piston's stroke, the lateral passage opening into one of the cylinder chambers, depending on position of the piston, the passage not passing through the outside surface of the cylinder wall; and a longitudinal bleed passage in the cylinder wall between the inside and outside surfaces of the cylinder wall joining the lateral passage with the adjacent port so that when the piston seal has passed the lateral passage approaching the end of its stroke, there is a bypass passage open between the two cylinder chambers, the passage having a sufficiently small cross-sectional area to cause the power cylinder to remain in phase with the series connected slave cylinder at the beginning of the power cylinder stroke, wherein the lateral passage passes partially through the cylinder wall and the longitudinal passage comprises a cutaway portion on the outside diameter of the cylinder wall, with the adjacent cylinder head having an overlapping portion extending longitudinally over the longitudinal passage.

2. A fluid power cylinder utilized in a series circuit with a slave cylinder in a master-slave relationship, the power cylinder having a cylinder wall, forward and rearward heads welded to the ends of the cylinder wall, the rearward head having a port therein for exterior fluid communication with a valve which selectively: (a) provides communication with a pump supplying fluid pressure, (b) closes off communication with the power cylinder, or (c) provides communication with a drain; the forward head having a port therein, the slave cylinder having a single port therein for exterior fluid communication with the port in the forward head; a piston rod extending outwardly from the slave cylinder; a piston having a circumferential seal in sliding contact with the inside surface of the power cylinder wall, dividing the cylinder into forward and rearward chambers, a piston rod attached to the piston and extending outwardly through the forward head, wherein the improvement comprises:

a lateral passage in the power cylinder wall positioned approximate at least one end of the cylinder and located so that the piston seal passes over the lateral passage near that end of the piston's stroke, the lateral passage opening into one of the cylinder chambers, depending on position of the piston, the passage not passing through the outside surface of the cylinder wall; and a longitudinal bleed passage in the cylinder wall between the inside and outside surfaces of the cylinder wall joining the lateral passage with the adjacent port so that when the piston seal has passed the lateral passage approaching the end of its stroke, there is a bypass passage open between the two cylinder chambers, the passage having a sufficiently small cross-sectional area to cause the power cylinder to remain in phase with the series connected slave cylinder at the beginning of the power cylinder stroke, wherein the longitudinal passage is drilled in the cylinder wall from a point of juncture of the cylinder wall and head at an angle offset from the axis of the cylinder so as to intersect the inside surface of the cylinder wall thus forming the lateral passage.

3. A fluid power cylinder utilized in a series circuit with a slave cylinder having a single port, the power cylinder having:

a cylinder wall;

a first head welded to one end of the cylinder wall and having a first port;

a second head welded to the other end of the cylinder wall and having a second port;

means for providing a flow of fluid to and from the first port;

a fluid communication between the second port and the slave cylinder port;

a piston within the power cylinder;

a circumferential seal on the piston and in sliding contact with the cylinder wall;

a rearward chamber within the cylinder extending between the first head and the seal;

a forward chamber within the cylinder extending between the seal and the second head;

a piston rod attached to the piston and extending outwardly through the second head;

in which the improvement comprises:

a lateral opening in the inside surface of the cylinder wall positioned approximate at least one of the heads, located so that when the piston is adjacent to that head, the lateral opening is clear of the seal and open to the chamber extending from the seal to the other head; and a longitudinal bleed passage within the cylinder wall between the inside and outside surfaces of the cylinder wall joining the lateral opening with the adjacent head and its port to provide a bypass between the two chambers, the bypass causing the power cylinder and the slave cylinder to start and end at least one end of their respective strokes at substantially the same time, the longitudinal passage comprising a cutaway portion on the outside of the cylinder wall and an overlapping portion of the adjacent cylinder head extending longitudinally over the longitudinal passage.

* * * * *